US010073399B1

(12) United States Patent
Osadchyy et al.

(10) Patent No.: US 10,073,399 B1
(45) Date of Patent: Sep. 11, 2018

(54) SYSTEMS AND METHODS FOR REPLENISHMENT SERVICES

(71) Applicant: KYOCERA Document Solutions Inc., Osaka (JP)

(72) Inventors: Oleksandr Osadchyy, Concord, CA (US); Ricardo Ruiz, Concord, CA (US)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/589,997

(22) Filed: May 8, 2017

(51) Int. Cl.
*G03G 15/00* (2006.01)

(52) U.S. Cl.
CPC ..... *G03G 15/553* (2013.01)

(58) Field of Classification Search
CPC ..... G03G 15/553
See application file for complete search history.

(56) References Cited

U.S. PATENT DOCUMENTS 6,633,732 B2 10/2003 Siegel et al.
8,000,615 B2 8/2011 Mizuyama
8,582,986 B2 11/2013 Kawai
2002/0002492 A1 1/2002 Okazawa
2008/0079989 A1* 4/2008 Agnetta ..... G03G 15/55 358/1.15
2016/0062293 A1* 3/2016 Nakamura ..... G03G 15/553 399/8

* cited by examiner

*Primary Examiner* — Clayton E Laballe
*Assistant Examiner* — Jas Sanghera
(74) *Attorney, Agent, or Firm* — McDonnell Boehnen Hulbert & Berghoff LLP

(57) ABSTRACT

Example systems and related methods may provide replenishment services for a plurality of printing devices. An example method includes receiving, at a replenishment server, information indicative of at least one aspect of a printing device. The printing device includes a sensor configured to obtain the information about the at least one aspect. The method includes, based on the received information, accumulating historical data corresponding to the at least one aspect of a plurality of printing devices. The method further includes receiving, at the replenishment server, information indicative of the at least one aspect of a target printing device. The method yet further includes determining a trigger based on a comparison of the information received from the target printing device with the historical data corresponding to the at least one aspect of the plurality of printing devices and taking an action based on the trigger type.

16 Claims, 12 Drawing Sheets

SYSTEMS AND METHODS FOR REPLENISHMENT SERVICES

BACKGROUND

Some conventional printing device management systems include a server that monitors various levels of supplies (e.g., toner, ink, paper, etc.) and maintenance information (e.g., number of printouts, roller wear, paper feed status, etc.). The server may issue automatic orders to replenish supplies when they are less than a threshold level. Such systems may allow a user to select a threshold level to trigger the orders.

SUMMARY

Example embodiments described herein relate to systems and methods for reliably triggering shipments of consumables and/or maintenance actions based on information obtained from printing devices.

In a first aspect, a system is provided. The system includes a replenishment server and a plurality of printing devices communicatively coupled to the replenishment server. Each printing device of the plurality of printing devices includes a sensor configured to provide information indicative of at least one aspect of the respective printing device. The system also includes a controller that includes at least one processor and a memory. The at least one processor executes instructions stored in the memory so as to carry out operations. The operations include receiving, at the replenishment server, information indicative of the at least one aspect of the respective printing device from at least a portion of the plurality of printing devices. The operations also include, based on the received information, accumulating historical data corresponding to the at least one aspect of the plurality of printing devices. The operations further include receiving, at the replenishment server, information indicative of the at least one aspect of a target printing device of the plurality of printing devices. The operations yet further include comparing the information received from the target printing device with the historical data corresponding to the at least one aspect of the plurality of printing devices. The operations additionally include, based on the comparison, determining a trigger condition and a trigger type. The operations include, in response to determining the trigger condition, causing the replenishment server to carry out an action based on the trigger type.

In a second aspect, a method is provided. The method includes receiving, at a replenishment server, information indicative of at least one aspect of a respective printing device from a plurality of printing devices communicatively coupled to the replenishment server. Each printing device of the plurality of printing devices includes a sensor configured to provide the information indicative of the at least one aspect of the respective printing device. The method also includes, based on the received information, accumulating historical data corresponding to the at least one aspect of the plurality of printing devices. The method further includes receiving, at the replenishment server, information indicative of the at least one aspect of a target printing device of the plurality of printing devices. The method additionally includes comparing the information received from the target printing device with the historical data corresponding to the at least one aspect of the plurality of printing devices. The method yet further includes, based on the comparison, determining a trigger condition and a trigger type. The method includes, in response to determining the trigger condition, causing the replenishment server to take an action based on the trigger type.

Other aspects, embodiments, and implementations will become apparent to those of ordinary skill in the art by reading the following detailed description, with reference where appropriate to the accompanying drawings.

DETAILED DESCRIPTION

Figure 1:
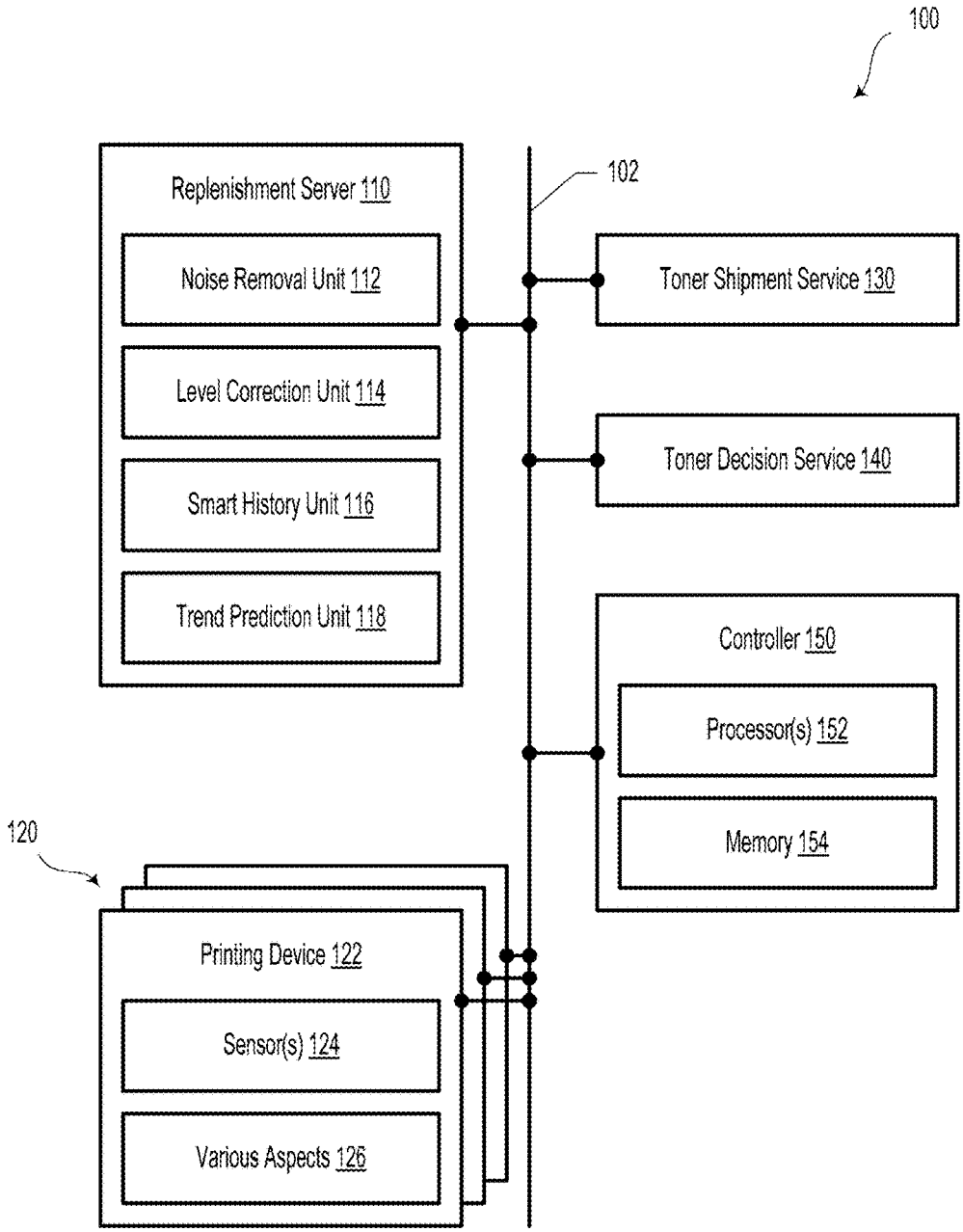
FIG. 1 is a schematic diagram illustrating a system, according to an example embodiment.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

I. Overview

The present disclosure relates to making accurate, automated decisions by a cloud replenishment service on behalf of individual printing devices. Such decisions are based on processing and analyzing the toner history, usage, and other status information from a plurality of printing devices.

To reduce the cost of printing devices, the sensors that provide information to the server or the embedded approximation logic may be of lower quality. In some cases, these lower quality sensors may provide inaccurate, untimely, or otherwise poor quality information. In other words, the information provided to the device management system may be unreliable and/or inaccurate.

Embodiments described herein include a printing device management system that provides more accurate triggering of shipments and maintenance actions based on accumulated information from a plurality of printing devices. Such embodiments may leverage the computing power and information storage capabilities of a cloud server network. In some example embodiments, aggregated information from the plurality of printing devices may provide recognizable usage, under-reporting, and over-reporting patterns. A comparison may be performed between sensor data from a given printing device and such recognizable patterns. Additionally or alternatively, based on the comparison, a trigger command may be scheduled for a future date/time.

In other words, systems and methods described herein need not directly utilize the information from a given printing device to initiate replenishment or service decisions. Instead, the information may be utilized by one or more modules, each of which may be configured to identify, compensate, or mitigate a particular concern. These modules may interact with one another, for example, by providing information to one another. Specialized knowledge, obtained by expert knowledge and/or machine learning, may be applied to noise and mis-leveling on a module-by-module basis. In such a manner, systematic and gradual improvement may be provided by pre-processing and data analysis. Furthermore, systems and methods herein may provide more reliable automated decision making based on collective data from a plurality of printing devices, rather than an individual data set from a single printing device.

In an example embodiment, a consumer purchases a printing device (e.g., a relatively inexpensive printer or multi-function device) and subscribes the printing device to a toner replenishment service based, at least in part, on a cloud server network. The printing device may include one or more basic sensors. For example, the printing device may include a basic toner level sensor. In such a scenario, the basic toner level sensor may be configured to work reliably for an average usage and environment. However, variances in several different usage or environmental factors may affect the accuracy and/or reliability of toner level reporting by the basic sensor. Among the usage and environmental factors include humidity, elevation, temperatures, frequent or rare usage rate, small or large print jobs, user intervention such as moving or shaking the printing device (or the toner container). In the case that one or more of the factors fall outside normal ranges, the individual printing device may report inaccurate toner levels (or another type of printing device status information) to the cloud replenishment service. The cloud replenishment service needs to make the decision on automatic toner shipment that meets 2 objectives:

1. End of cycle=one shipment. Avoid redundant shipments and thus returns of the too many or no longer needed toner containers.

2. Just in time or early delivery. Avoid downtimes when consumer runs out of toner and no replacement is shipped yet.

II. System Examples

FIG. 1 is a schematic diagram illustrating a system 100, according to an example embodiment. The system 100 includes a replenishment server 110 (e.g., for toner replenishment) and a plurality of printing devices 120 communicatively coupled to the replenishment server 110. In an example embodiment, the replenishment server may include a cloud-based server network.

Each printing device (e.g., printing device 122) of the plurality of printing devices 120 includes a sensor 124 configured to provide information indicative of at least one aspect 126 of the respective printing device 122. Each of the plurality of printing devices 120 may be owned and/or operated by a customer (e.g., an individual, a business, etc.). The customer may subscribe to the system 100 and the methods described herein. For example, a subscription to the system 100 may provide automatic and timely toner cartridge shipments, automatic replacement paper shipments, automatic repair requests, etc. The subscription may additionally or alternatively provide shipment cancellation (e.g., in the case of an errant shipment) and/or automatic returns with little or no customer action.

It will be understood that while certain aspects and embodiments of the present disclosure are described within the context of replenishment of printer toner, other types of replenishment and repair services are contemplated. For example, the method and systems described herein may be applied to shipments of paper or other consumables relating to printing devices, replacement parts (e.g., replacement rollers to replace worn-out rollers), service calls, etc. Such other embodiments are expressly contemplated herein.

The system 100 also includes a toner shipment service 130 and a toner decision service 140. The toner shipment service 130 may be configured to initiate, track, and manage shipments of toner to a customer. The toner shipment service 130 may additionally track and manage returns of toner cartridges. As described herein, it will be understood that a shipment of a consumable "to a customer" may include the shipment being delivered proximate to a location of the given printing device and not necessarily a customer's physical office or headquarters location.

In example embodiments, the replenishment server 110 may provide the toner decision service 140 with certain information, such as a date of last low level (e.g., where a low level is for a given printing device is triggered at or below a threshold level such as 20% or 10% of capacity for a given consumable) or a date of empty (e.g., where a given printing device has reported an empty level, such as 0% of capacity for a given consumable). Additionally or alternatively, the replenishment service 110 may provide predicted error cases, historical error cases, and/or statistics (e.g., average shipping time to a given customer, average consumption for a given customer, a confidence value for the level data received from a given printing device, etc.). Other types of information may be provided by the replenishment server 110 to the toner decision service 140.

The toner decision service 140 may be operable to determine whether a shipment of a consumable (e.g., toner) should be sent to a customer. As such, the toner decision service 140 may provide a trigger (e.g., a signal) to the toner shipment service 130 so as to initiate a shipment of toner to a customer. The toner decision service 140 may additionally or alternatively be operable to cancel or recall such shipments.

In some embodiments, the toner decision service 140 may include support personnel, who may carry out at least some of the functions of the toner decision service 140. The support personnel may decide on whether predicted or historical error cases apply to information received from a given printer device. Furthermore, the support personnel may be able to override automatic shipments and/or initiate shipments of a consumable (e.g., an extra shipment of toner based on anticipated need or an increased toner usage rate).

The system 100 includes a controller 150 that includes at least one processor 152 and a memory 154. The at least one processor 152 executes instructions stored in the memory 154 so as to carry out one or more of the operations described herein. It will be understood that controller 150 may include a cloud server or another type of distributed computing system. In some embodiments, some operations carried out by the controller 150 may affect and/or involve other elements of system 100. Furthermore, the operations of controller 150 may be executed by a physical processor that resides with a first element of the replenishment system 100 (e.g., the toner decision system 140) based on information received from a second element of the system 100 (e.g., the noise removal unit 112).

The operations include receiving, at the replenishment server 110, information indicative of the at least one aspect 126 of the respective printing device from at least a portion of the plurality of printing devices 120. That is, the printing devices may provide a variety of information about their current status. For example, the printing devices may provide their toner level (e.g., a percentage of full toner, an integer, a fraction, or another measurement unit), a counter (e.g., an accumulated number of pages printed, an accumulated number of pages fed, accumulated number of paper/toner reloads, incremental versions of such counters, etc.), a capacity (e.g., a maximum sheet capacity, sheet size type capacity, toner volume capacity, capacity for number of printed pages, etc.), or a coverage amount (e.g., the average number of dots per square inch per page, total number of dots per page, integrated coverage area, etc.). In some embodiments, the printing devices may provide such information to the toner decision service 140.

The operations include, based on the received information, accumulating historical data corresponding to the at least one aspect 126 of the plurality of printing devices 120.

In an example embodiment, the at least one aspect 126 may include a toner or ink level. In such a scenario, the historical data may include corresponding historical toner levels across at least a portion of the plurality of printing devices 120. Such historical data may be maintained, managed, and/or obtained by the toner decision service 140. In such a scenario, the toner decision service 140 is configured to manage information on shipped and installed toner containers.

In the case of a toner decision service, the trigger type may include a toner low trigger type. In such scenarios, causing the replenishment server 110 to carry out the action comprises causing the replenishment server 110 to notify the toner shipment service 130 to initiate a shipment of replacement toner.

In some embodiments, the replenishment service 110 may include a noise removal unit 112. The noise removal unit 112 may be operable to detect noise patterns in a level history (e.g., toner level history) from a given printing device. In response to detecting such noise patterns, the noise removal unit 112 may remove the spurious data and replace it with one or more data points.

As an example, the noise removal unit 112 may detect or recognize various noise patterns such as: single-day dips, multi-day dips, single-day spikes, multi-day spikes, and/or a generally noisy signal over a given time period. The noise removal unit 112 may detect such noise patterns via various methods. For example, the noise removal unit 112 may be configured to detect the noise patterns due to extreme level changes, a comparison with a counter value (e.g., a large drop in toner level without a corresponding increase in the pages printed counter), or a comparison with a coverage value (e.g., a large drop in toner level over an average amount of pages printed without a corresponding increase in the coverage value). Other methods or means of determining the noise patterns are possible and contemplated herein.

The noise removal unit 112 may adjust or correct spurious/noisy data points in various ways. For example, the noise removal unit 112 may remove corrupt data points. In such a scenario, the level history may be adjusted to remove a data entry corresponding to the corrupt data point. Additionally or alternatively, the noisy data points may be replaced with median values (e.g., an average level between the data points immediately before and after the noisy data point(s)). In other embodiments, the noisy data points may be replaced with a weighted average, a slope line, a regression, or another type of adjusted data values.

In some embodiments, the noise removal unit 112 may be operable to adjust toner and counter data to remove data values less than 0 or more than 100% (or more than a maximum capacity of a given consumable type). Furthermore, in some examples, the noise removal unit 112 may ignore, remove, and/or discard data entries older than a threshold date in the past (e.g., older than 24 months ago). Yet further, counter entries equal to zero may be ignored or treated as invalid. Toner entries with a daily difference of less than zero and/or duplicate counter entries from the same day with the same counter value may be removed, ignored, or deleted.

In other words, the noise removal unit 112 is configured to determine a noise pattern based on at least one of: determining an inconsistent toner level change for a given printing device over a given time period based on a comparison with a corresponding integrated toner coverage amount or a corresponding number of printed pages of the given printing device over the given time period, determining an inconsistent toner level change of a given printing device based on a comparison with corresponding historical toner level changes of other printing devices of a same device model as the given printing device, or determining an inconsistent toner level change of a given printing device from a localized group of printing devices over a given time period based on a comparison with an aggregated historical average toner level change of the localized group of printing devices over the given time period. The noise removal unit 112 may also be configured to, in response to determining the noise pattern, provide, to the toner decision service 140, corrected historical toner levels corresponding to the target printing device (e.g., printing device 122).

Additionally or alternatively, the replenishment server 110 may include a level correction unit 114. In some embodiments, the level correction unit 114 may be configured to analyze information, such as toner level data, and adjust it to correct for inconsistent or inaccurate level information. In some embodiments, the level correction unit 114 may be configured to ignore 0% levels and extreme level changes. The level correction unit 114 may be configured to correct for various common patterns (e.g., D-shape data correction or L-shape data correction). The level correction 114 may be configured to adjust a capacity (e.g., total toner capacity, etc.). The level correction unit 114 may additionally or alternatively include model-specific logic. The model-specific logic may perform adjustments on the received information based on a model of a given printing device. Furthermore, the level correction unit 114 may correct for various sensor malfunctions or abnormalities and may also correct for issues like roller or toner cartridge wear.

In example embodiments, the level correction unit 114 may be configured to determine an adjustment pattern based on at least one of: determining an inconsistent toner level change for a given printing device over a given time period based on a comparison with a corresponding integrated toner coverage amount or a corresponding number of printed pages of the given printing device over the given time period, determining an inconsistent toner level change of a given printing device based on a comparison with corresponding historical toner level changes of other printing devices of a same device model as the given printing device, or determining an inconsistent toner level change of a given printing device from a localized group of printing devices over a given time period based on a comparison with an aggregated historical average toner level change of the localized group of printing devices over the given time period. The level correction unit 114 may also be configured to, in response to determining the adjustment pattern, provide, to the toner decision service, corrected historical toner levels corresponding to the target printing device (e.g., printing device 122).

In an example embodiment, the replenishment server 110 may include a smart history unit 116. In some embodiments, the smart history unit 116 may generate and/or adjust toner (or another consumable) history. The smart history unit 116 may be used in cases where there is insufficient historical data to provide a reliable trend with which to predict when a given printing device may need a shipment of a given consumable. The smart history unit 116 may conduct a computation-heavy trend analysis over one or more models of printing devices. In some example embodiments, the smart history unit 116 may be configured to construct a 1-month history based on two days of standard use, weekends, and holidays.

The smart history unit 116 may be configured to provide predicted consumable level data (e.g., anticipated toner levels). In an example, the smart history unit 116 may provide predicted data at least two days into the future. The smart history unit 116 may additionally or alternatively be configured to reduce the level data to a more manageable data set via compression, encoding, or other means. For example, the smart history unit 116 may use artificial intelligence (AI) to regroup or cluster the data to provide a more useful data set. The smart history unit 116 may be configured to determine similar trends between co-located printing devices. For example, as co-located printing devices may be used at similar rates, the smart history unit 116 may cross-reference data received from co-located printing devices so as to ensure reliability of various information such as toner level data.

The smart history unit 116 is configured to: determine insufficient historical data is included in historical toner levels corresponding to the target printing device, based on the determination of insufficient historical data, generate simulated historical toner levels corresponding to the target printing device, and provide, to the toner decision service, the simulated historical toner levels.

In some embodiments, the adjustment pattern may include at least one of: a D-shape pattern or an L-shape pattern. Other adjustment patterns are contemplated and possible within the scope of the present disclosure.

In some embodiments, the replenishment server may include a trend prediction unit 118. The trend prediction unit 118 may construct or otherwise provide a trend function to estimate a toner lifetime, or usage rate. The trend prediction unit 118 may be configured to provide such estimates based on an average linear toner use trend, periodic changes in print volumes, and/or slowdowns or accelerations in printing.

In some embodiments, the trend prediction unit 118 may be configured to convert absolute levels (e.g., toner level percentages) into daily differences (e.g., −1.2%, −0.8%, etc.). Additionally or alternatively, the trend prediction unit 118 may decompose the level history data into portions so as to calculate linear regressions, calculate multiple Fourier functions (e.g., Fourier transforms) for each week/month/year. The trend prediction unit 118 may compose a resulting trend function based on the linear regressions and/or the Fourier transforms.

Multiple Fourier functions are calculated based on the formula below, where k=2 for faster performance. Higher values are expected to give better accuracy but also require more computing resources.

$$F(x) = \frac{a_0}{2} + \sum_{n=1}^{k} [a_n \cos(nx) + b_n \sin(nx)]$$

$k = 2$, but could be up to 00 depending on computing resources and level of confidence In an example embodiment, the trend prediction unit 118 may be configured to assign weights to trends and/or data points that have occurred most recently. That is, weighting may be applied to emphasize events that took place a short time ago because such events may have more bearing on the present performance of a given printing device (and its consumption of consumables like toner) than events that took place a long time ago. Additionally or alternatively, the trend prediction unit 118 may provide toner replacement metrics such as: timestamp, toner level, and counter value before replacement; timestamp, toner level, and counter at replacement; statistics such as (page count, min, max, mean, standard deviation, and median) to help illustrate the number of pages printed between toner cartridge replacement. The trend prediction unit 118 may additionally provide information regarding signal to noise ratio, data point density, missing input summary, etc.

In some embodiments, the trend prediction unit 118 is configured to determine, based on historical toner levels corresponding to the target printing device, an estimated toner lifetime, wherein the estimated toner lifetime comprises a predicted number of days before empty.

The operations include receiving, at the replenishment server 110, information indicative of the at least one aspect 126 of a target printing device 122 of the plurality of printing devices 120.

The operations include comparing the information received from the target printing device 122 with the historical data corresponding to the at least one aspect 126 of the plurality of printing devices 120.

The operations include, based on the comparison, determining a trigger condition and a trigger type. Furthermore, the operations include, in response to determining the trigger condition, causing the replenishment server 110 to carry out an action based on the trigger type. In such scenarios, causing the replenishment server to carry out the action is further based on the toner decision service determining whether: multiple shipments should be combined, toner containers have been misplaced or incorrectly installed, toner containers have been replaced too early, or a given shipment should be closed based on a comparison between shipped and installed containers.

Figure 2:
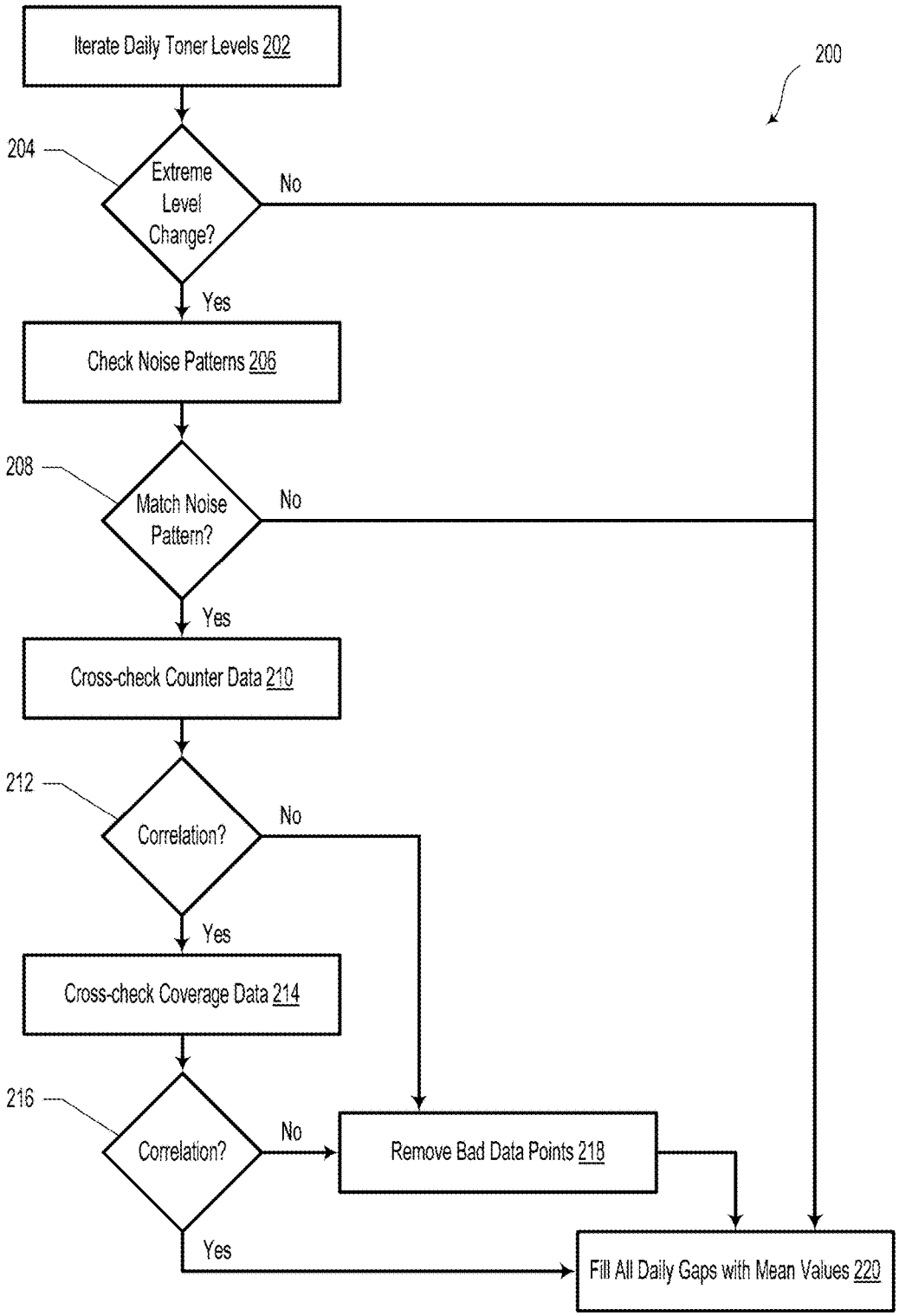
FIG. 2 is a flow chart illustrating certain functions of a noise removal unit, according to an example embodiment.

FIG. 2 is a flow chart 200 illustrating certain functions of a noise removal unit, according to an example embodiment. In some embodiments, the functions could be carried out fully or in part by noise removal unit 112, as illustrated and described in reference to FIG. 1. In some examples, the functions of the flow chart 200 may be carried out once per day. In other examples, the functions of the flow chart 200 may be carried out at longer or shorter intervals, or on an as-requested or as-needed basis.

In some embodiments, the noise removal unit may receive information regarding current toner levels. In such scenarios, the noise removal unit may iterate daily toner levels 202 (e.g., update a historical database of toner levels based on date and/or time).

As described herein, the noise removal unit may check historical toner levels for an extreme level change 204. If no extreme level change is detected, the functions of flow chart 200 may fill any gaps with mean values (220) and end the function routine.

The noise removal unit may check for suspected noise patterns 206 and try to match present and historical level information with such noise patterns 208. As described elsewhere herein, suspected noise patterns may include large changes in level, or too much noise over a given timeframe.

In embodiments, the noise removal unit may a cross-reference with counter data 210. In such a scenario, a sudden drop in toner level may be confirmed to be spurious level information if it does not correspond to a similar sudden increase in pages printed. Other types of counter information may be used (e.g., roller revolutions, remaining paper capacity, etc.). If there is no correlation 212, the data points may be removed 218 and the gaps may be filled with mean values 220.

Additionally or alternatively, some embodiments may include a cross-reference between level data and coverage data 214. In such a scenario, a sudden drop in toner level may be confirmed to be spurious level information if it does not correspond to a similar sudden increase in the coverage area of the pages printed. Other types of coverage information may be used. If there is no correlation 216 between the sudden drop in toner level and the coverage information, the spurious data points may be removed 218 and the gaps may be filled with mean values 220.

Figure 3A:
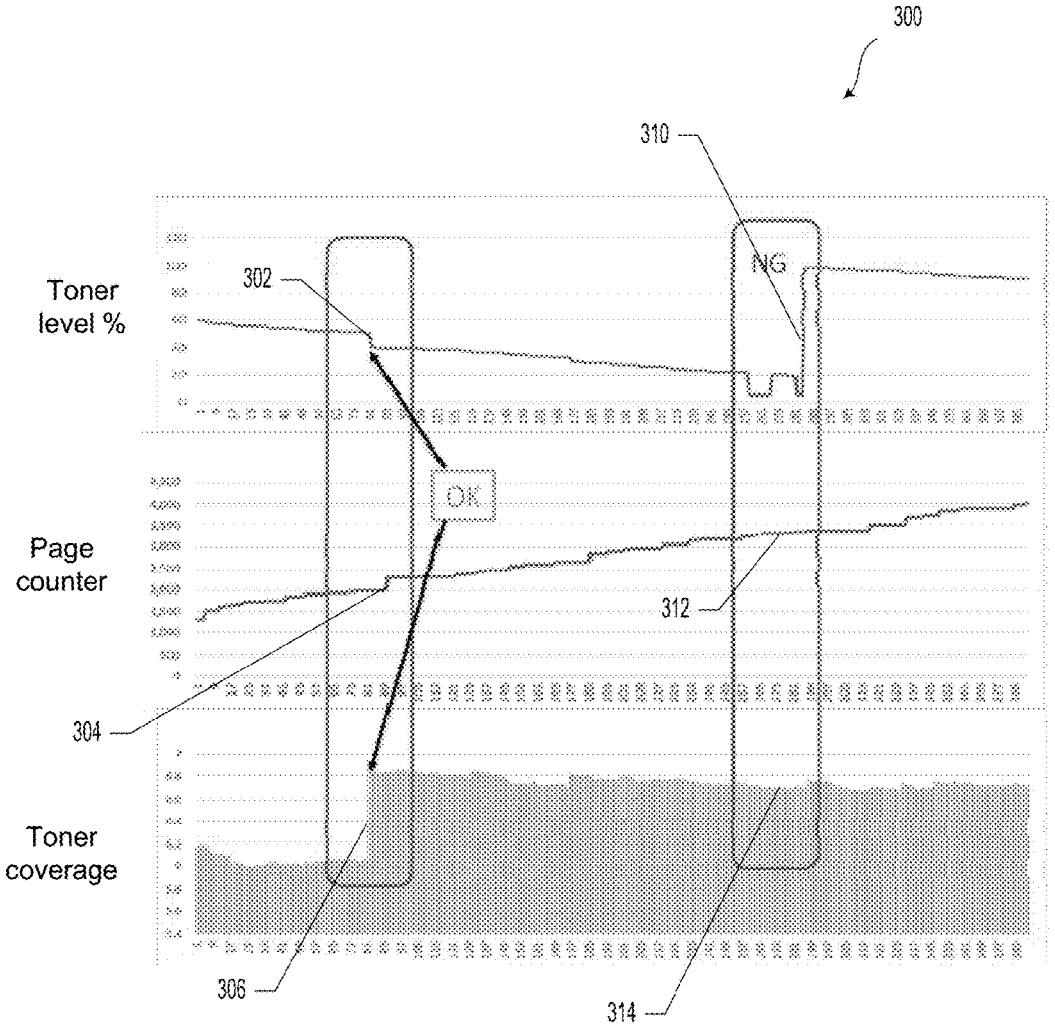
FIG. 3A illustrates information from a printing device, according to an example embodiment.

FIG. 3A illustrates information 300 from an example printing device, according to an example embodiment. Information 300 includes toner level (%), page counter, and toner coverage (e.g., % of page). Information 300 includes a first toner level drop 302. In response to the first toner level drop 302, the noise removal unit may cross-reference with the page counter, which provides a corresponding page counter increase 304 around the same time as the first toner level drop 302. Furthermore, additionally or alternatively, the noise removal unit may cross-reference with the toner coverage information, which provides a corresponding increase in toner coverage 306 around the same time as the first toner level drop 302. Accordingly, the noise removal unit may determine that the first toner level drop 302 does not represent a spurious or noisy signal.

Conversely, the information 300 includes a series of second toner level drops 310 as the toner cartridge is depleted around 20% of capacity. In response to the series of second toner level drops 310, the noise removal unit may cross-reference the page counter information 312 and/or the toner coverage information 314. In such a scenario, the noise removal unit may determine that the series of second toner level drops 310 does represent a spurious or noisy signal. In response to such a determination, the noise removal unit may delete and replace the noisy data points with average or median data values.

Figure 3B:
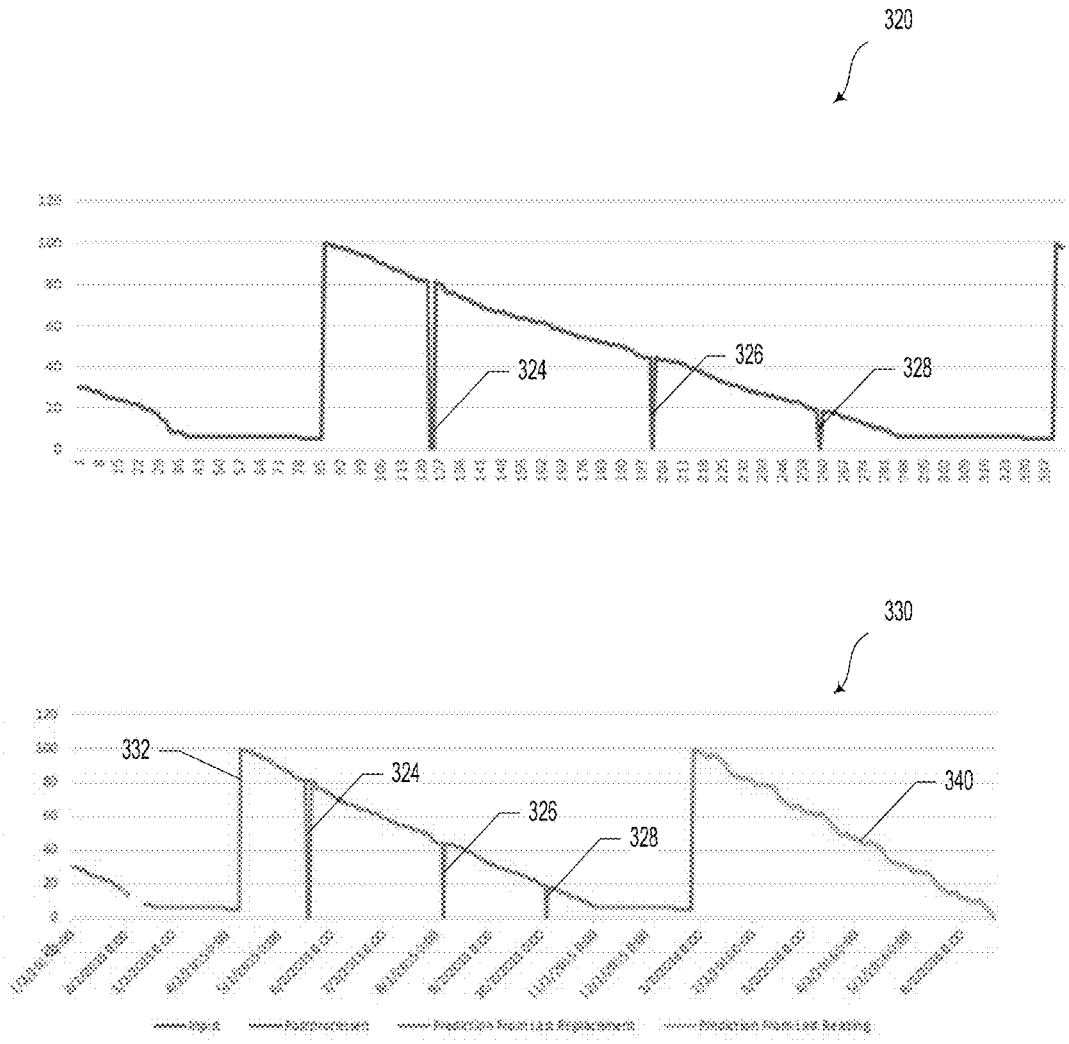
FIG. 3B illustrates as-reported information and post-processed information from a printing device, according to an example embodiment.

FIG. 3B illustrates as-reported information 320 and post-processed information 330 from a printing device, according to an example embodiment. In such an example, the pre-processed information may include toner level information 320, which may in turn include several sudden drops in toner level (324, 326, and 328). The noise removal unit may recognize such drops as noisy data entries and replace them with average data values. For example, the post-processed toner level information 330 may include post-processed data 332 that has been adjusted to delete the noisy data entries corresponding to the sudden toner level drops 324, 326, and 328 and replace them with average values.

Additionally or alternatively, in some embodiments, the data processing may include providing a predicted toner level 340 based, at least in part, on prior toner level data. Various management or planning functions may be enabled by such predicted level information. For example, predictive staffing (e.g., shift staffing), predictive supply shipping logistics, and/or financial projections may be provided based on such predicted level information.

Figure 3C:
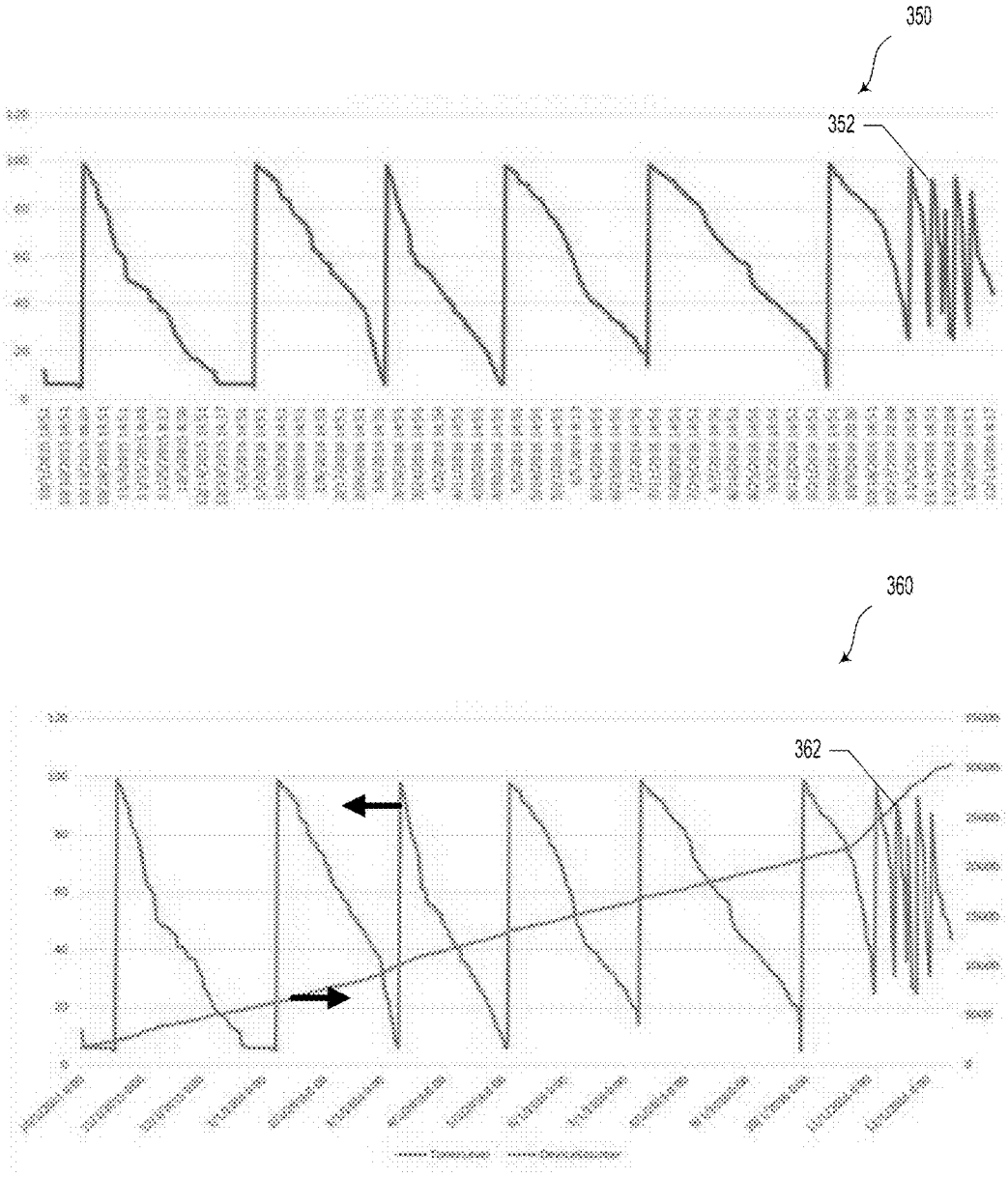
FIG. 3C illustrates as-reported information and post-processed information from a printing device, according to an example embodiment.

FIG. 3C illustrates as-reported information 350 and post-processed information 360 from a printing device, according to an example embodiment. The as-reported information 350 includes intense toner usage at the end of the historical reporting period, illustrated by narrow, jagged lines on the right portion of the as-reported information 350 (e.g., portion 352). In such a scenario, the noise removal unit may cross-reference with a page counter to determine if the increased toner usage corresponds with a higher rate of paper usage. As illustrated in FIG. 3C, the post-processed information 360 includes the same narrow, jagged toner usage (e.g., portion 362) because the page counter information correlates to an increased overall printing rate. In other words, the noise removal unit does not consider the as-reported information 350 as noise because of a corresponding increase in the total printed pages.

Figure 3D:
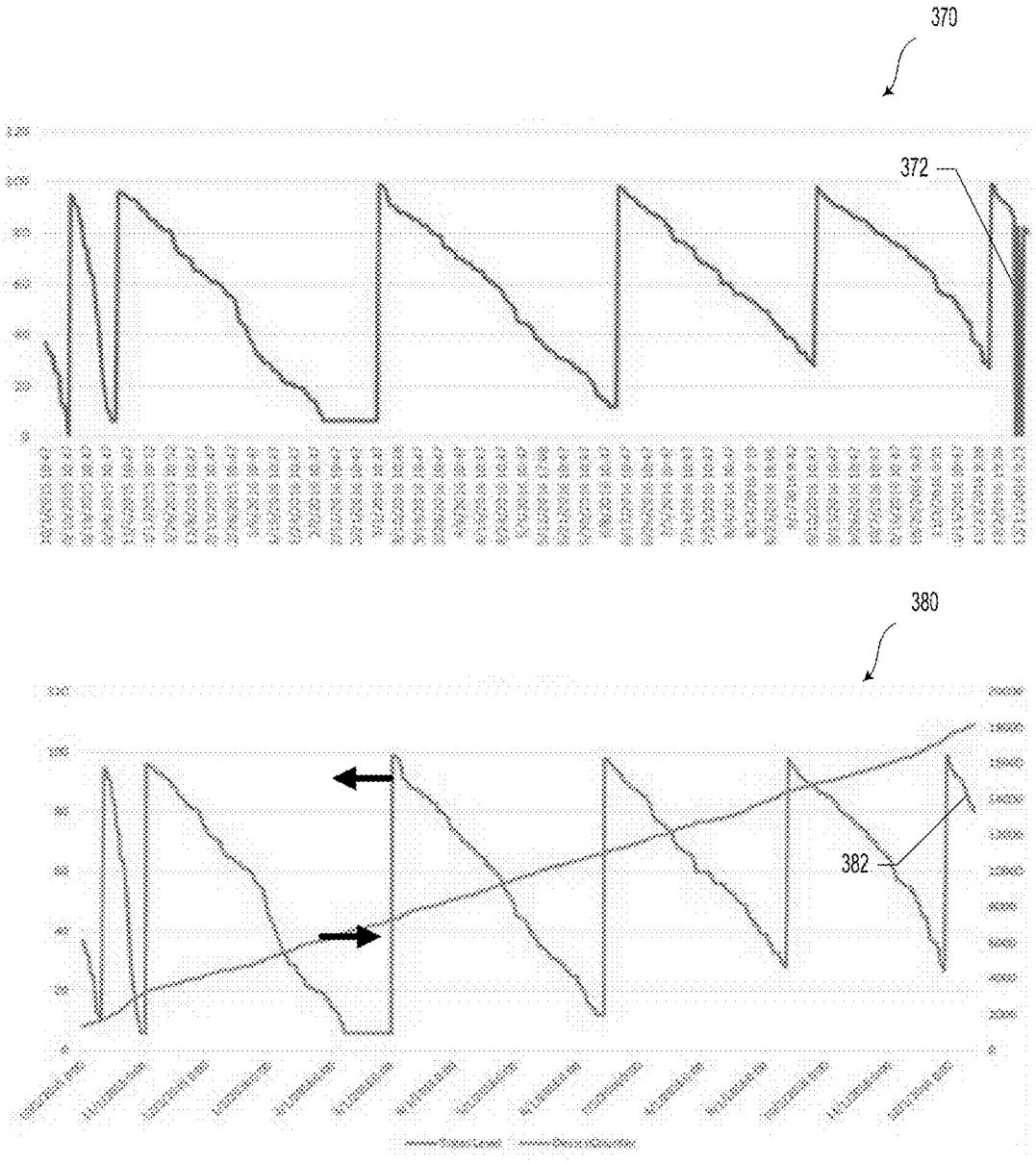
FIG. 3D illustrates as-reported information and post-processed information from a printing device, according to an example embodiment.

FIG. 3D illustrates as-reported information 370 and post-processed information 380 from a printing device, according to an example embodiment. As illustrated, the as-reported information 370 may include an intense toner usage "spike" 372. In this case, the noise removal unit may cross-reference the number of pages printed around the same time as the toner usage spike 372. As there is no corresponding jump in the number of pages printed or sizeable increase in the printing rate, the noise removal unit may consider the toner usage spike 372 as noise. As such, the post-processed data may include at least a portion of replaced data points 382, which may include average values according to a slope between two valid points. Other types of replacement data points are possible. For example, the data points between the valid points may be filled with a constant slope line or another type of regression line or multi-segment line.

Figure 3E:
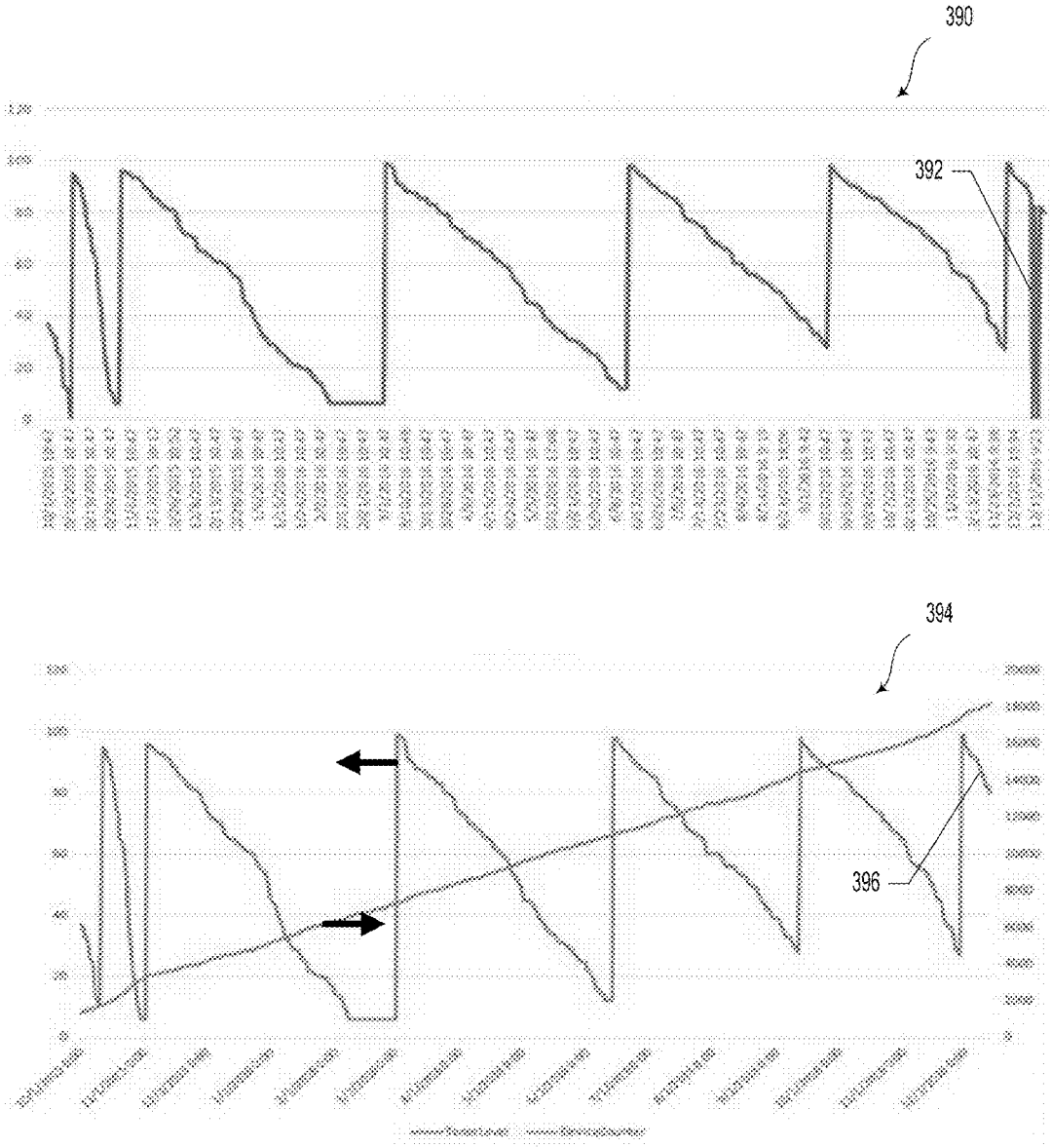
FIG. 3E illustrates as-reported information and post-processed information from a printing device, according to an example embodiment.

FIG. 3E illustrates as-reported information 390 and post-processed information 394 from a printing device, according to an example embodiment. As illustrated, the as-reported information 390 includes a sudden toner down-spike 392. In a similar or identical fashion as in prior examples, the noise removal unit may cross-reference other information to confirm whether the sudden toner down-spike 392 is noise. In this case, the information from the page counter does not correspond to the down-spike 392. As such, the noise removal unit may determine that the sudden spike is a noise signal and may delete it. As such, the post-processed information 396 may include replacement data points that smooth the down-spike 392 portion of the data. Other ways to adjust noisy data points are possible.

Figure 4:
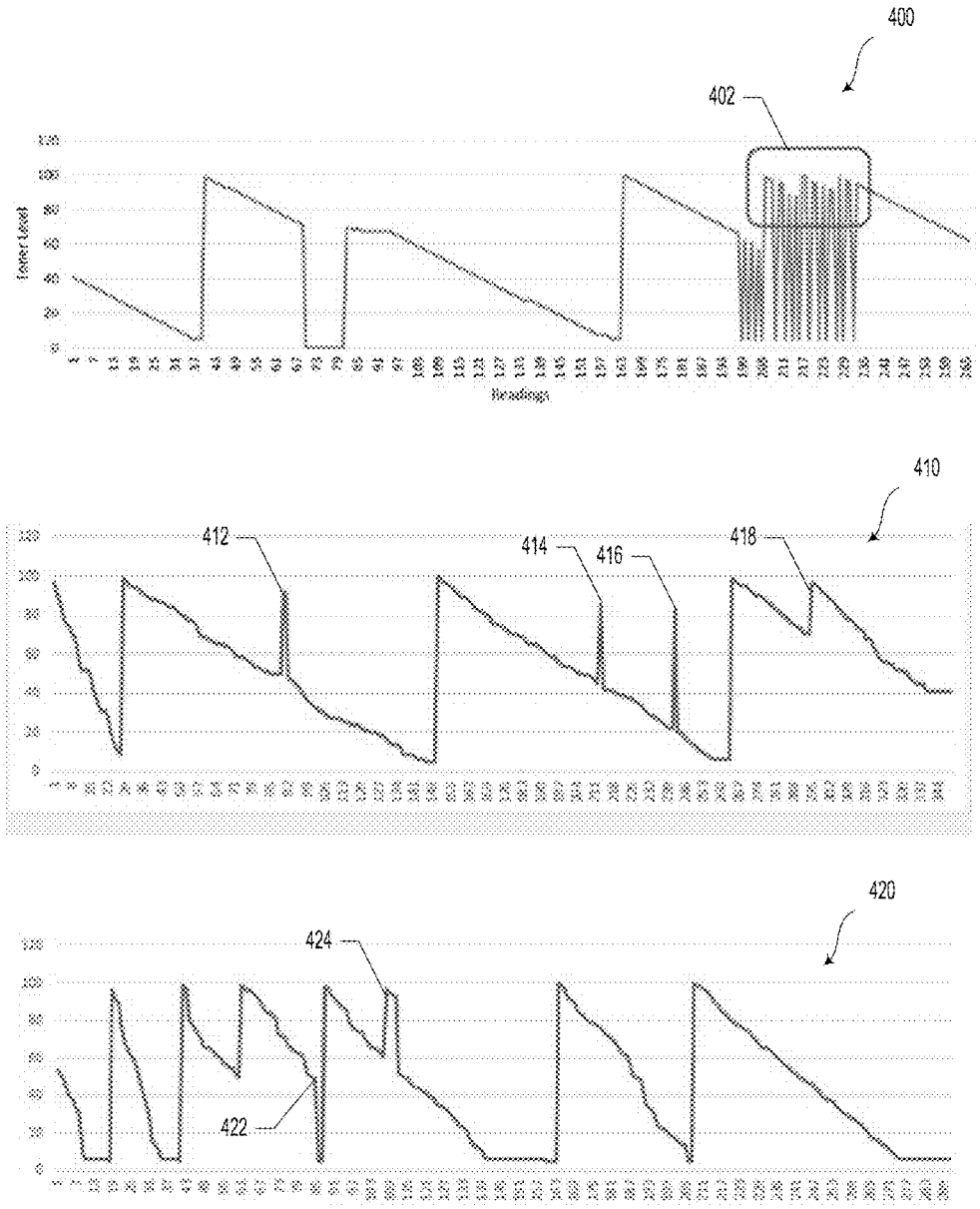
FIG. 4 illustrates as-reported information from a printing device, according to example embodiments.

FIG. 4 illustrates as-reported information 400, 410, and 420 from a printing device, according to example embodiments. Each of the as-reported information 400, 410, and 420 may indicate a likely error signal scenario. For instance, the as-reported information 400 may include a succession of dense spikes in toner level 402. The as-reported information 410 may include intermittent upward spikes (e.g., spikes 412, 414, and 416) and/or an upward shift 418 that does not correspond to a toner cartridge replacement. Furthermore, the as-reported information 420 includes a sudden drop in toner level 422 and a sudden rise in toner level 424 that does not correspond to a toner cartridge replacement.

Figure 5:
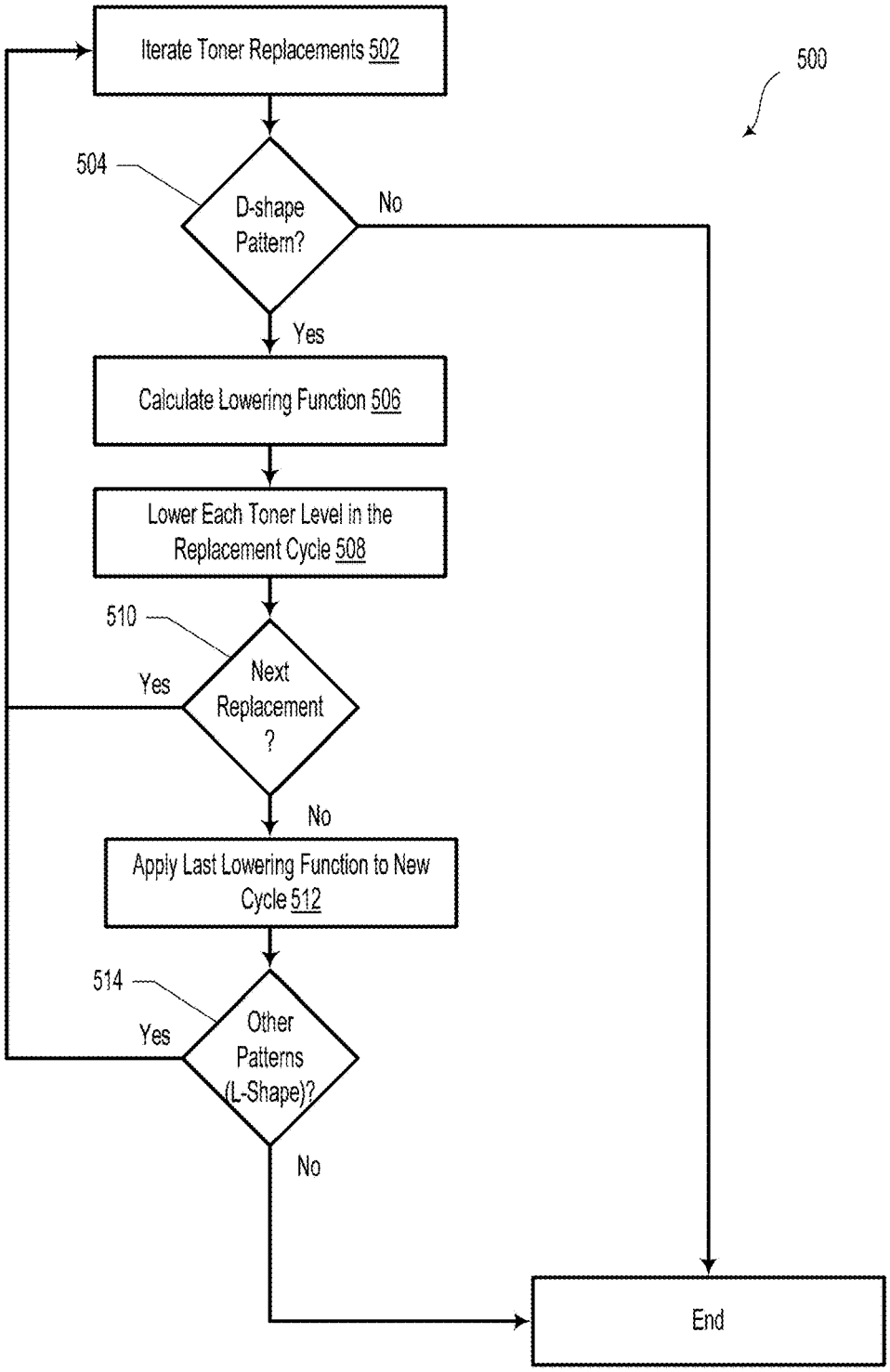
FIG. 5 is a flow chart illustrating certain functions of a level correction unit, according to an example embodiment.

FIG. 5 is a flow chart 500 illustrating certain functions of a level correction unit, according to an example embodiment. As an initial matter, flow chart 500 may include receiving information regarding whether a given toner cartridge has been replaced for a given printing device. That is, when a new toner cartridge is replaced, a toner replacement counter may be iterated or incremented 502. The flow chart 500 may include determining whether a toner history of the given printing device includes a D-shape pattern. If not, the routine may end. If the level correction unit determines that a D-shape pattern exists, the level correction unit may calculate a lowering function 506. Calculating the lowering function 506 may include determining a value or a slope of values by which level information should be adjusted. In response to calculating the lowering function 506, each toner level in a replacement cycle 510 may be lowered.

Thereafter, in some embodiments, the level correction unit may check whether a replacement has taken place 510. If a toner cartridge replacement has occurred, the functions may return to the iterate toner replacement step 502. If a toner cartridge replacement has not occurred, the last lower function may be applied to the new cycle 512 (e.g., the data obtained since the last toner cartridge replacement). The level correction unit may be configured to check for other patterns (e.g., L-shaped patterns, etc.).

Figure 6:
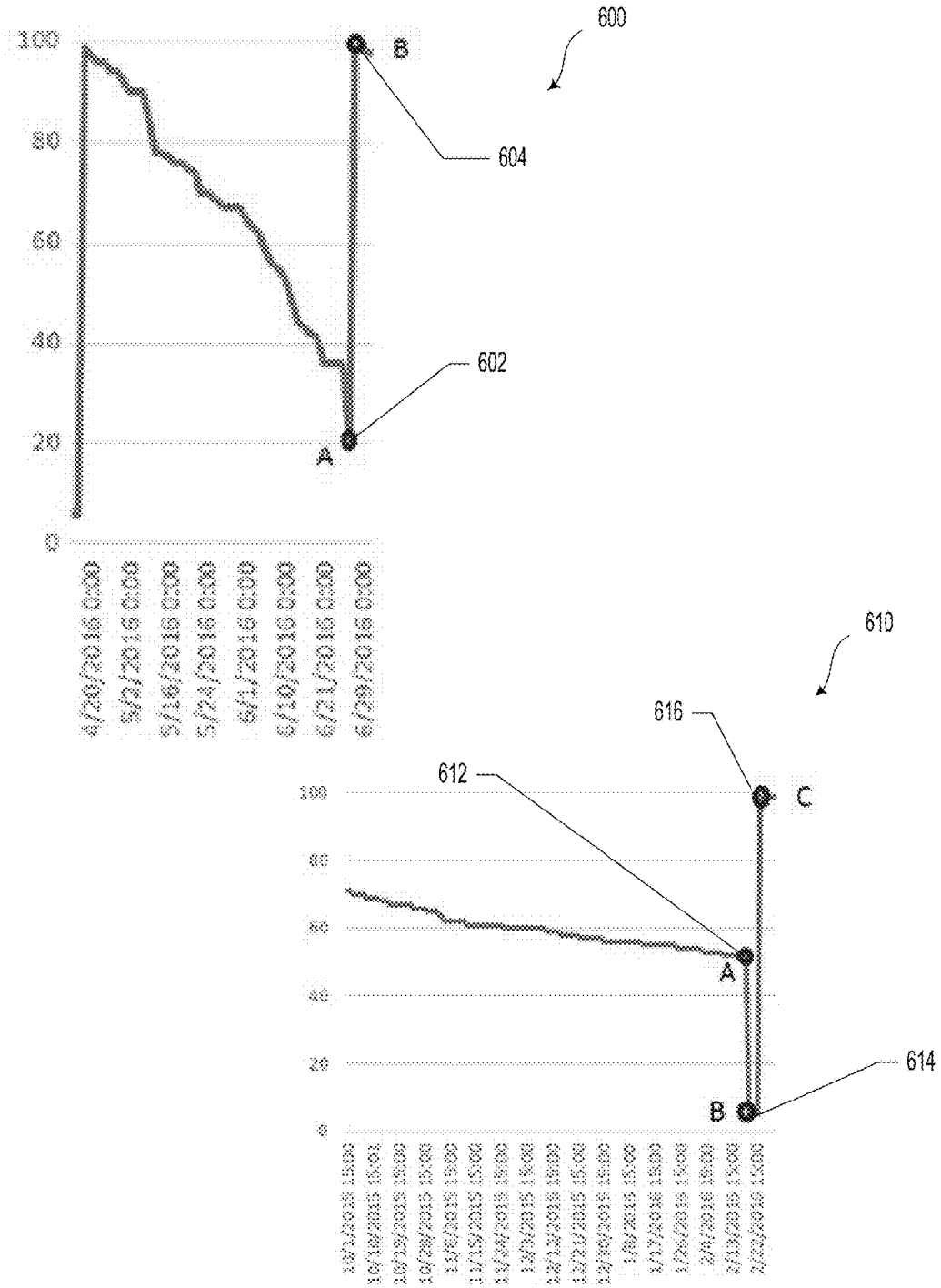
FIG. 6 illustrates D-shape information from a printing device, according to example embodiments.

FIG. 6 illustrates D-shape information received from a printing device, according to example embodiments. For example, systems and methods described herein may determine a two-point D-shape from information 600. Specifically, information 600 includes a low-point 602 that is not equal to zero (in this case it is approximately 21%) and a subsequent high-point 604 of about 100%, measured after consumable replacement.

Furthermore, systems and methods described herein may determine a three-point D-shape from information 610. Namely, the three-point D-shape may include a rapid drop between point 612 (e.g., 51%) to point 614 (e.g., 4%), and a return to point 616, after a toner cartridge replacement, substantially at 100%. In response to determining a two-point or three-point D-shape from a given printer, the level correction unit may adjust an offset or level amount, based on the characteristics of the D-shape.

An algorithm for normalizing D-shaped toner cycles may include the following process.

Get all toner cycles

For each toner cycle, identify if it has a D-shaped pattern.

If the cycle does not include a D-shaped pattern, do nothing.

However, a cycle may be a D-shaped pattern if the previous toner level to last toner level or toner low level (=5%) is equal to or greater than 10%.

If the cycle is D-shaped, at least in part, the toner levels may be normalized.

To calculate new toner levels, carry out the following:

If StartingLevel−DropOffHeight >0, then newTonerLevel=(currentTonerLevel dropOffHeight)*(starting Level/starting Level−dropOffHeight), where startingLevel is the first level in the cycle and where dropOffheight is the difference of a last toner level from its previous level.

If newTonerLevel is >100 or <0 (out of bounds), then newTonerLevel is the currentLevel.

Figure 7:
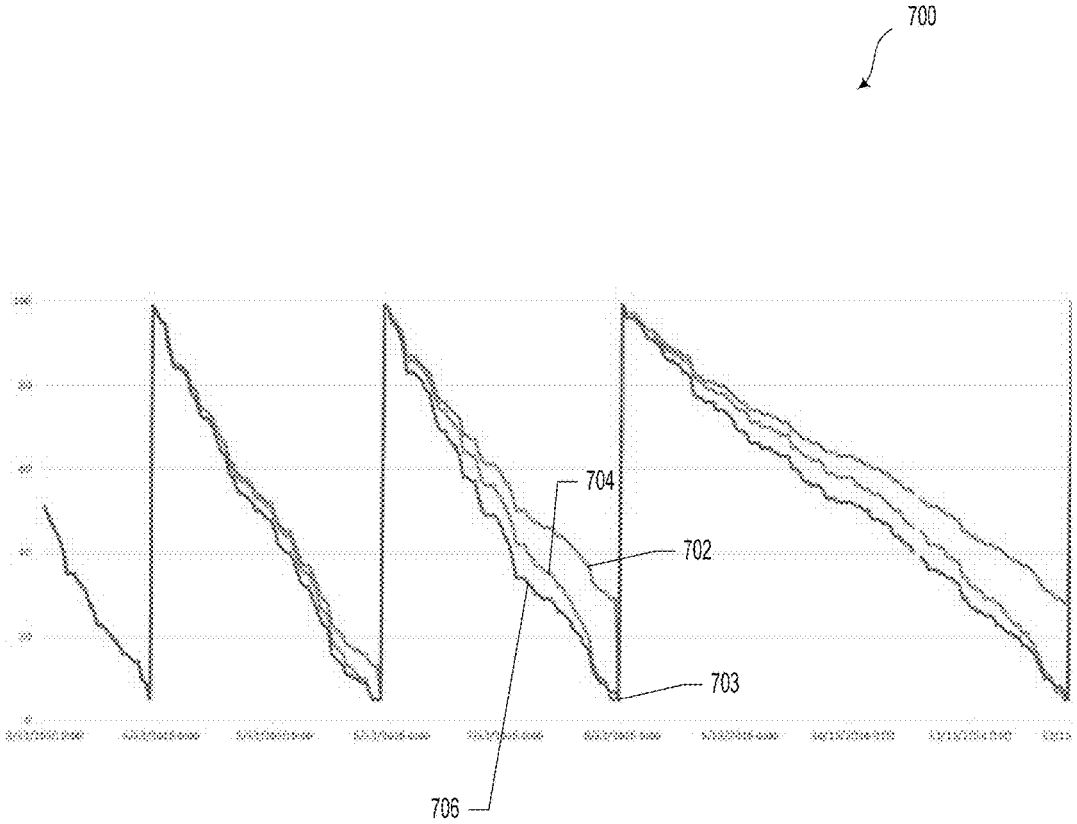
FIG. 7 illustrates as-reported information and post-processed information from a printing device, according to an example embodiment.

FIG. 7 illustrates several data waveforms 700. Namely, FIG. 7 illustrates as-reported information 702, first post-processed information 704 and second post-processed information 706 from a printing device, according to an example embodiment. The as-reported information 702 is the original data from the printing device, which includes a rapid level drop from 29% to 5%. The first post-processed information 704 is corrected data based on the levels by a linear formula. The second post-processed information 706 is corrected data based on the levels given by a proportional formula.

III. Method Examples

Figure 8:
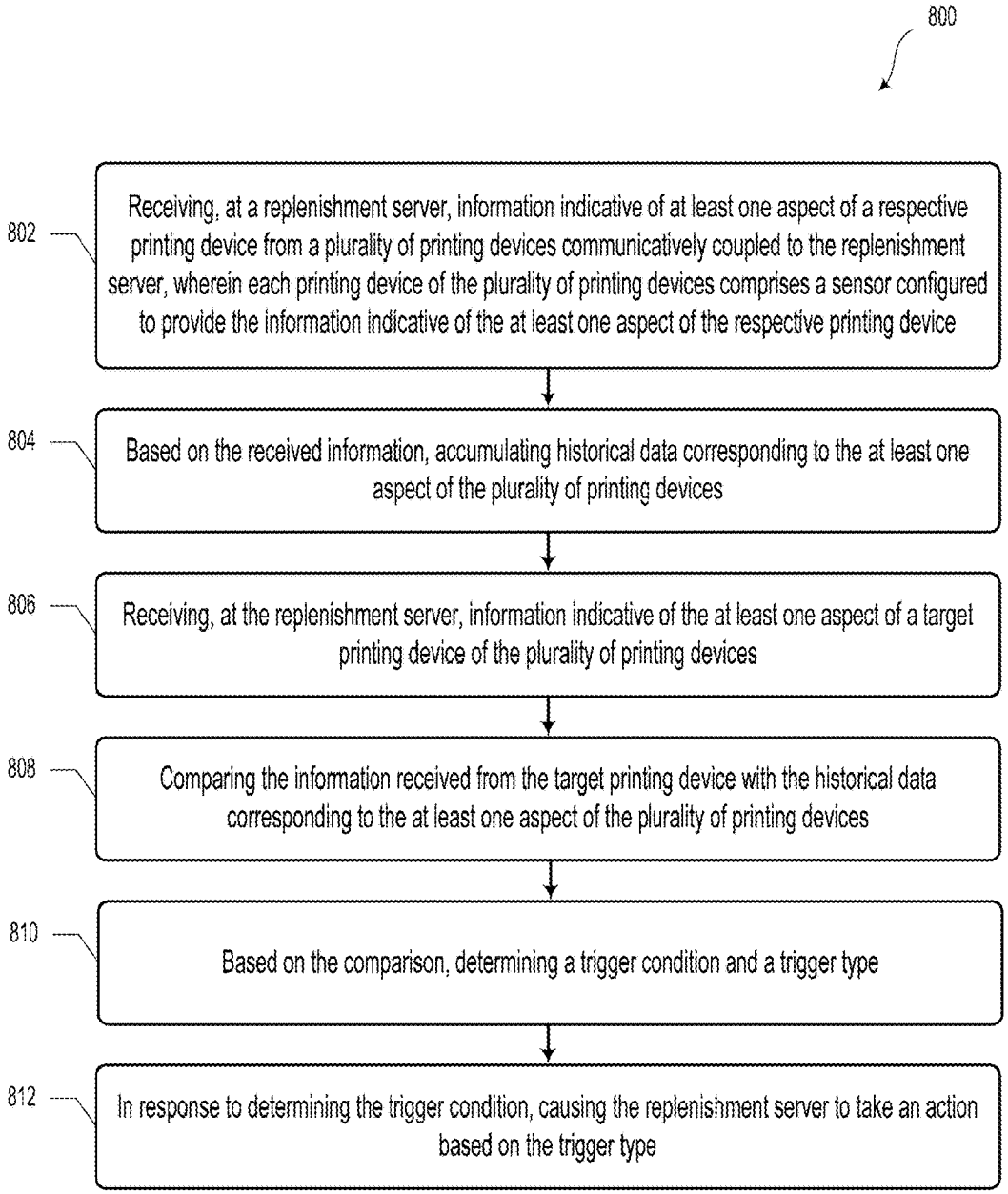
FIG. 8 is a flow diagram illustrating a method, according to an example embodiment.

FIG. 8 is a flow diagram illustrating a method 800, according to an example embodiment. Although FIG. 8 illustrates method 800 as including certain blocks that are carried out in a particular order, it will be understood that blocks may be added, subtracted, and/or carried out in a different order. Furthermore some or all of the blocks of method 800 may be carried out by one or more elements of system 100 (e.g., controller 150) as illustrated and described in reference to FIG. 1. In some embodiments, some blocks of method 800 may be carried out, at least in part, by a human operator. Additionally, method 800 may include some or all elements of process 200 and process 500, as illustrated and described in reference to FIGS. 2 and 5.

Block 802 includes receiving, at a replenishment server, information indicative of at least one aspect of a respective printing device from a plurality of printing devices communicatively coupled to the replenishment server. Each printing device of the plurality of printing devices includes a sensor configured to provide the information indicative of the at least one aspect of the respective printing device.

In an example embodiment, the at least one aspect may include a toner level. For example, in such a scenario, the historical data may correspond to historical toner levels across at least a portion of the plurality of printing devices. In some embodiments, the historical data corresponding to historical toner levels is managed by a toner decision service. In such scenarios, the toner decision service is configured to manage information on shipped and installed toner containers.

Block 804 includes, based on the received information, accumulating historical data corresponding to the at least one aspect of the plurality of printing devices.

Block 806 includes receiving, at the replenishment server, information indicative of the at least one aspect of a target printing device of the plurality of printing devices.

Block 808 includes comparing the information received from the target printing device with the historical data corresponding to the at least one aspect of the plurality of printing devices.

Block 810 includes, based on the comparison, determining a trigger condition and a trigger type.

Block 812 includes, in response to determining the trigger condition, causing the replenishment server to carry out an action based on the trigger type. In some embodiments, causing the replenishment server to carry out the action may be further based on the toner decision service determining whether: multiple shipments should be combined, toner containers have been misplaced or incorrectly installed, toner containers have been replaced too early, or a given shipment should be closed based on a comparison between shipped and installed containers.

In some embodiments, the trigger type may include a toner low trigger type. In such scenarios, causing the replenishment server to carry out the action includes causing the replenishment server to notify a toner shipment service to initiate a shipment of replacement toner.

In some embodiments, the method further includes determining, at a noise removal unit, a noise pattern based on at least one of: determining an inconsistent toner level change for a given printing device over a given time period based on a comparison with a corresponding integrated toner coverage amount or a corresponding number of printed pages of the given printing device over the given time period, determining an inconsistent toner level change of a given printing device based on a comparison with corresponding historical toner level changes of other printing devices of a same device model as the given printing device, or determining an inconsistent toner level change of a given printing device from a localized group of printing devices over a given time period based on a comparison with an aggregated historical average toner level change of the localized group of printing devices over the given time period. In such scenarios, in response to determining the noise pattern, the method includes providing, to the toner decision service, corrected historical toner levels corresponding to the target printing device.

In an example embodiment, the method further includes determining, at a level correction unit, an adjustment pattern based on at least one of: determining an inconsistent toner level change for a given printing device over a given time period based on a comparison with a corresponding integrated toner coverage amount or a corresponding number of printed pages of the given printing device over the given time period, determining an inconsistent toner level change of a given printing device based on a comparison with corresponding historical toner level changes of other printing devices of a same device model as the given printing device, or determining an inconsistent toner level change of a given printing device from a localized group of printing devices over a given time period based on a comparison with an aggregated historical average toner level change of the localized group of printing devices over the given time period. In such scenarios, the method may also include, in response to determining the adjustment pattern, providing, to the toner decision service, corrected historical toner levels corresponding to the target printing device.

In some embodiments, the method includes determining, at a smart history unit, insufficient historical data is included in historical toner levels corresponding to the target printing device. In such scenarios, the method may include, based on the determination of insufficient historical data, generating, at the smart history unit, simulated historical toner levels corresponding to the target printing device. The method may further include providing, to the toner decision service, the simulated historical toner levels.

In yet further embodiments, the method may include determining, at a trend prediction unit, an estimated toner lifetime. Such a determination is based on historical toner levels corresponding to the target printing device. The estimated toner lifetime include a predicted number of days before reaching an empty toner level.

While various examples and embodiments have been disclosed, other examples and embodiments will be apparent to those skilled in the art. The various disclosed examples and embodiments are for purposes of illustration and are not intended to be limiting, with the true scope and spirit being indicated by the following claims.

What is claimed is:

1. A system comprising:
- a replenishment server;
- a toner decision service;
- a plurality of printing devices communicatively coupled to the replenishment server, wherein the each printing device of the plurality of printing devices comprises:
  - a sensor configured to provide information indicative of at least one aspect of the respective printing device; and
- a controller, wherein the controller comprises at least one processor and a memory, and wherein the at least one processor executes instructions stored in the memory so as to carry out operations, the operations comprising:
  - receiving, at the replenishment server, information indicative of the at least one aspect of the respective printing device from at least a portion of the plurality of printing devices;
  - based on the received information, accumulating historical data corresponding to the at least one aspect of the plurality of printing devices;
  - receiving, at the replenishment server, information indicative of the at least one aspect of a target printing device of the plurality of printing devices, wherein the at least one aspect comprises a toner level, wherein the historical data corresponds to historical toner levels across at least a portion of the plurality of printing devices, wherein the historical data corresponding to historical toner levels is managed by the toner decision service, wherein the toner decision service is configured to manage information on shipped and installed toner containers;
  - comparing the information received from the target printing device with the historical data corresponding to the at least one aspect of the plurality of printing devices;
  - based on the comparison, determining a trigger condition and a trigger type; and
  - in response to determining the trigger condition, causing the replenishment server to carry out an action based on the trigger type.

2. The system of claim 1, wherein the replenishment server comprises a cloud-based server network.

3. The system of claim 1, wherein causing the replenishment server to carry out the action is further based on the toner decision service determining whether:
- multiple shipments should be combined;
- toner containers have been misplaced or incorrectly installed;
- toner containers have been replaced too early; or
- a given shipment should be closed based on a comparison between shipped and installed containers.

4. The system of claim 1, further comprising a toner shipment service, wherein the trigger type comprises a toner low trigger type, and wherein causing the replenishment server to carry out the action comprises causing the replenishment server to notify the toner shipment service to initiate a shipment of replacement toner.

5. The system of claim 1, further comprising a noise removal unit, wherein the noise removal unit is configured to:

determine a noise pattern based on at least one of:

determining an inconsistent toner level change for a given printing device over a given time period based on a comparison with a corresponding integrated toner coverage amount or a corresponding number of printed pages of the given printing device over the given time period;

determining an inconsistent toner level change of a given printing device based on a comparison with corresponding historical toner level changes of other printing devices of a same device model as the given printing device; or determining an inconsistent toner level change of a given printing device from a localized group of printing devices over a given time period based on a comparison with an aggregated historical average toner level change of the localized group of printing devices over the given time period; and in response to determining the noise pattern, provide, to the toner decision service, corrected historical toner levels corresponding to the target printing device.

6. The system of claim 1 further comprising a level correction unit, wherein the level correction unit is configured to:

determine an adjustment pattern based on at least one of:

determining an inconsistent toner level change for a given printing device over a given time period based on a comparison with a corresponding integrated toner coverage amount or a corresponding number of printed pages of the given printing device over the given time period;

determining an inconsistent toner level change of a given printing device based on a comparison with corresponding historical toner level changes of other printing devices of a same device model as the given printing device; or determining an inconsistent toner level change of a given printing device from a localized group of printing devices over a given time period based on a comparison with an aggregated historical average toner level change of the localized group of printing devices over the given time period; and in response to determining the adjustment pattern, provide, to the toner decision service, corrected historical toner levels corresponding to the target printing device.

7. The system of claim 6, wherein the adjustment pattern comprises at least one of: a D-shape pattern or an L-shape pattern.

8. The system of claim 1, further comprising a smart history unit, wherein the smart history unit is configured to:

determine insufficient historical data is included in historical toner levels corresponding to the target printing device;

based on the determination of insufficient historical data, generate simulated historical toner levels corresponding to the target printing device;

provide, to the toner decision service, the simulated historical toner levels.

9. The system of claim 1, further comprising a trend prediction unit, wherein the trend prediction unit is configured to:

determine, based on historical toner levels corresponding to the target printing device, an estimated toner lifetime, wherein the estimated toner lifetime comprises a predicted number of days before empty.

10. A method comprising, receiving, at a replenishment server, information indicative of at least one aspect of a respective printing device from a plurality of printing devices communicatively coupled to the replenishment server, wherein each printing device of the plurality of printing devices comprises a sensor configured to provide the information indicative of the at least one aspect of the respective printing device;

based on the received information, accumulating historical data corresponding to the at least one aspect of the plurality of printing devices;

receiving, at the replenishment server, information indicative of the at least one aspect of a target printing device of the plurality of printing devices;

comparing the information received from the target printing device with the historical data corresponding to the at least one aspect of the plurality of printing devices, wherein the at least one aspect comprises a toner level, wherein the historical data corresponds to historical toner levels across at least a portion of the plurality of printing devices, wherein the historical data corresponding to historical toner levels is managed by a toner decision service, wherein the toner decision service is configured to manage information on shipped and installed toner containers;

based on the comparison, determining a trigger condition and a trigger type; and in response to determining the trigger condition, causing the replenishment server to carry out an action based on the trigger type.

11. The method of claim 10, wherein causing the replenishment server to carry out the action is further based on the toner decision service determining whether:

multiple shipments should be combined;

toner containers have been misplaced or incorrectly installed;

toner containers have been replaced too early; or a given shipment should be closed based on a comparison between shipped and installed containers.

12. The method of claim 10, wherein the trigger type comprises a toner low trigger type, and wherein causing the replenishment server to carry out the action comprises causing the replenishment server to notify a toner shipment service to initiate a shipment of replacement toner.

13. The method of claim 10, further comprising:

determining, at a noise removal unit, a noise pattern based on at least one of:

determining an inconsistent toner level change for a given printing device over a given time period based on a comparison with a corresponding integrated toner coverage amount or a corresponding number of printed pages of the given printing device over the given time period;

determining an inconsistent toner level change of a given printing device based on a comparison with corresponding historical toner level changes of other printing devices of a same device model as the given printing device; or determining an inconsistent toner level change of a given printing device from a localized group of printing devices over a given time period based on a comparison with an aggregated historical average toner level change of the localized group of printing devices over the given time period; and in response to determining the noise pattern, providing, to the toner decision service, corrected historical toner levels corresponding to the target printing device.

14. The method of claim 10, further comprising:

determining, at a level correction unit, an adjustment pattern based on at least one of:

determining an inconsistent toner level change for a given printing device over a given time period based on a comparison with a corresponding integrated toner coverage amount or a corresponding number of printed pages of the given printing device over the given time period;

determining an inconsistent toner level change of a given printing device based on a comparison with corresponding historical toner level changes of other printing devices of a same device model as the given printing device; or determining an inconsistent toner level change of a given printing device from a localized group of printing devices over a given time period based on a comparison with an aggregated historical average toner level change of the localized group of printing devices over the given time period; and in response to determining the adjustment pattern, providing, to the toner decision service, corrected historical toner levels corresponding to the target printing device.

15. The method of claim 10, further comprising:

determining, at a smart history unit, insufficient historical data is included in historical toner levels corresponding to the target printing device;

based on the determination of insufficient historical data, generating, at the smart history unit, simulated historical toner levels corresponding to the target printing device;

providing, to the toner decision service, the simulated historical toner levels.

16. The method of claim 10, further comprising, determining, at a trend prediction unit, an estimated toner lifetime, wherein the determination is based on historical toner levels corresponding to the target printing device, wherein the estimated toner lifetime comprises a predicted number of days before empty.

* * * * *